United States Patent [19]

Pries

[11] 4,097,340

[45] Jun. 27, 1978

[54] APPARATUS FOR CLEANING COKE OVEN DOORS

[75] Inventor: Erich Pries, Bochum, Germany

[73] Assignee: Dr. C. Otto & Comp. G.m.b.H., Bochum, Germany

[21] Appl. No.: 827,286

[22] Filed: Aug. 24, 1977

[51] Int. Cl.[2] ..... C10B 43/08; B08B 3/02

[52] U.S. Cl. ..... 202/241; 15/93 A; 134/167 R; 134/180

[58] Field of Search ..... 202/241; 201/2; 134/167 R, 168 R, 172, 173, 180, 181, 39; 15/93 A

[56] References Cited

U.S. PATENT DOCUMENTS

| | | | |
|---|---|---|---|
| 3,847,753 | 11/1974 | Baird et al. | 202/241 |
| 3,892,250 | 7/1975 | Miko | 202/241 X |

*Primary Examiner*—Morris O. Wolk
*Assistant Examiner*—Roger F. Phillips
*Attorney, Agent, or Firm*—Thomas H. Murray

[57] ABSTRACT

Apparatus for cleaning incrusted deposits from the regions of coke oven doors between a central refractory sealing plug and a surrounding sealing edge or strip with the use of two pairs of nozzles carried on the upper and lower ends of a frame which can traverse the inner end of the door on which the sealing plug is carried. The frame has a length preferably one-half the height of the door such that the upper nozzles will clean the upper half of the door while the lower nozzles clean the lower half. The nozzles are pivotally carried on the frame such that they can be actuated to clean the horizontally-extending portions of the door between the sealing plug and the sealing strip at the upper and lower extremities of the door.

5 Claims, 6 Drawing Figures

APPARATUS FOR CLEANING COKE OVEN DOORS

BACKGROUND OF THE INVENTION

While not limited thereto, the present invention is particularly adapted for use in cleaning coke oven doors of the type wherein sealing of the doors is achieved by a steel straight edge, held by friction against a machine surface of the door casting by L-shaped bolts. Within the surrounding sealing strip or edge is a refractory sealing plug; and between the plug and the sealing strip is an area which becomes contaminated with tarry deposits which often harden into crusts. These crusts are produced by condensation from the constituents of the gas which is produced during coking. Very costly and complicated equipment employing rotating cleaning brushes is sometimes used for the purpose of cleaning the incrustations from the area between the sealing plug and the sealing strip; however cleaning of the doors in this manner is not always satisfactory.

In an attempt to overcome the disadvantages of mechanical cleaning devices, attempts have been made to clean coke oven doors having metal-to-metal seals by means of an array of high pressure fluid nozzles which remove the deposits on the sealing surfaces of the door and door frames with the use of overlapping jets of high pressure fluid, usually water, discharged at a pressure of about 200 atmospheres. While overlapping water jets can be employed in this manner to clean coke oven doors, it has been found that water is unsuitable as a cleaning agent for cleaning the coke oven door frame since removal of the water discharged in the cleaning process leads to difficulties on the oven platforms. Furthermore, it has now been found that it is not necessary to clean the sealing edge on the door or the coke oven frame so that water need not be sprayed onto the frame. Rather, it is important only to clean the region on the door between the sealing edge or strip and the refractory door plug since it is in this region where incrustations may form.

SUMMARY OF THE INVENTION

In accordance with the present invention, apparatus is provided for cleaning the regions of coke oven doors between a surrounding sealing edge and a refractory door plug, which apparatus employs only a single nozzle and single spray cone in any one region being cleaned. In order to hasten the cleaning process, a plurality of single nozzles is preferably employed, two for the bottom portion of the door on either side of the refractory plug and two for the upper portion.

Specifically, there is provided a frame which is vertically reciprocable along the side of a coke oven door which carries the aforesaid refractory sealing plug. A first pair of nozzles is carried on the upper portion of the frame on either side of the sealing plug and are arranged to force fluid, preferably water, into the upper portions of those regions of the coke oven door between the surrounding sealing edge and the door plug. A second pair of nozzles is carried on the lower portion of the frame and arranged to force liquid onto the lower portions of those regions of the coke oven door between the surrounding sealing strip and the door plug. Assuming that the frame has a length approximately one-half the length of the door, the upper pair of nozzles can be used to clean the upper part of the door upon upward movement of the frame, for example; and the lower pair of nozzles can be used to clean the lower portion of the door during downward movement of the frame.

In order to clean the horizontally-extending regions between the sealing edge and the refractory plug at the upper and lower ends of the door, the nozzles are pivotally mounted on the frame such that when they are adjacent the aforesaid horizontally-extending regions, they can be caused to pivot inwardly through a horizontal plane to effect cleaning of those regions.

The frame which supports the nozzles moves upwardly and downwardly in a vertical direction by means of rollers which engage vertically-extending track rails mounted on a support column in front of the door being cleaned. To protect the traversing frame against heat radiated by the door plug, a thermally-insulating protective shield is provided on the frame between the pivotal nozzles and surrounds the door plug during a cleaning operation.

The above and other objects and features of the invention will become apparent from the following detailed description taken in connection with the accompanying drawings which form a part of this specification, and in which.

Figure 1:
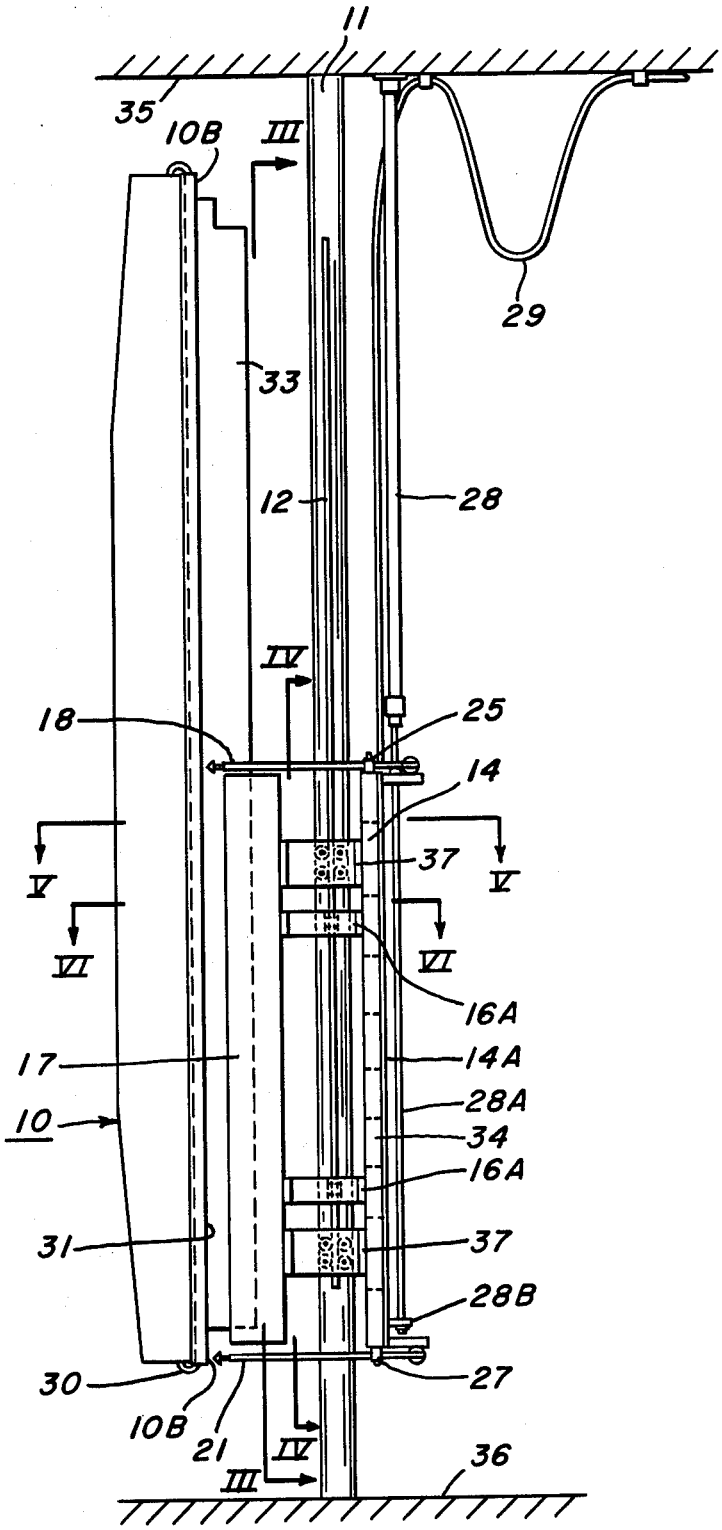
FIG. 1 is a side view of the cleaning apparatus of the invention with a raised coke oven door moved into position in front of the cleaning apparatus.
Figure 5:
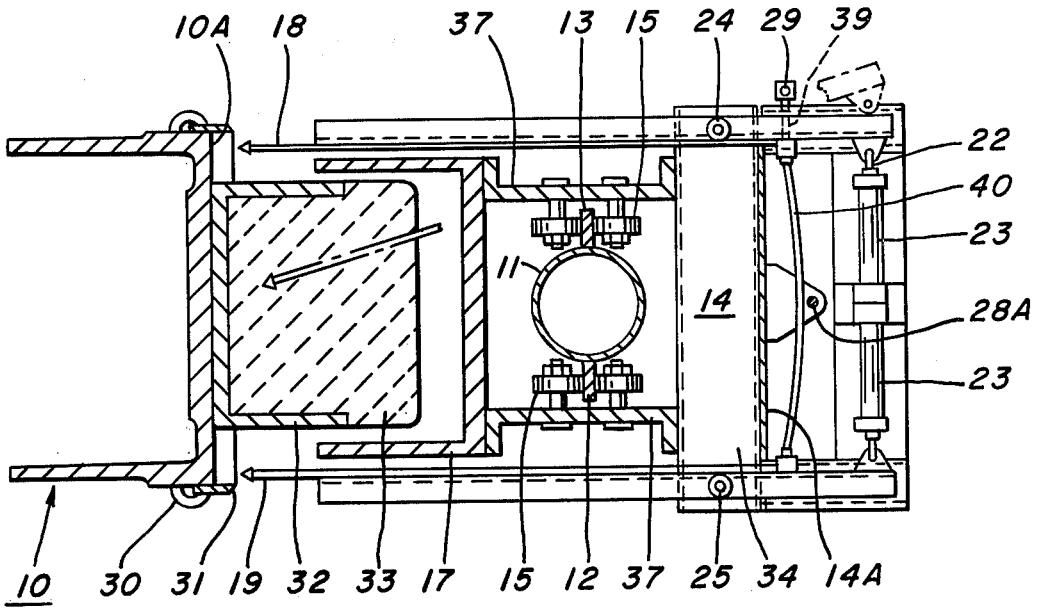
FIG. 5 is a horizontal section taken substantially along line V—V of FIG. 1.

With reference now to the drawings, and particularly to FIGS. 1 and 5, the coke oven door to be cleaned is identified generally by the reference numeral 10 and is generally of U-shaped cross section. Carried on the door 10, at the forward edge thereof, is a sealing strip or seal 31 which extends around the entire periphery of the door, including the top and bottom thereof. The sealing strip 31 is mounted on the door 10 by means of hook bolts 30. As shown, the sealing strip 31 completely surrounds a refractory door plug 33 mounted on the door by means of a metal plug holder 32. More or less crusty, tarry deposits are usually formed during the coking operation directly in the vertically-extending spaces 10A (FIG. 5) and the horizontally-extending spaces 10B (FIG. 1) between the door plug 33 and the sealing strip 31. It is the removal of such deposits that the novel apparatus of the invention is concerned with.

Figure 6:
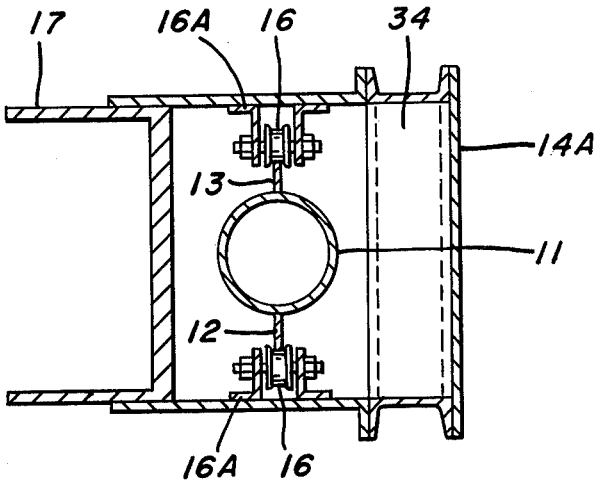
FIG. 6 is a horizontal section taken substantially along line VI—VI of FIG. 1.

The cleaning apparatus of the invention extends between an upper support 35 and a base 36 and comprises a rigid support column 11 which carries track rails 12 and 13, perhaps best shown in FIGS. 5 and 6. The cleaning apparatus can be fixed on a coke guide car or on the coke pushing machine and can be arranged so that the removed door can be moved in front of the cleaning apparatus by a suitable manipulating device (not shown) with the refractory plug 33 facing the cleaning apparatus. Mounted on the track rails 12 and 13 is a frame 14 comprising a fixed rear wall 14A and a plurality of structural members 34 which give rigidity to the frame.

Figure 2:
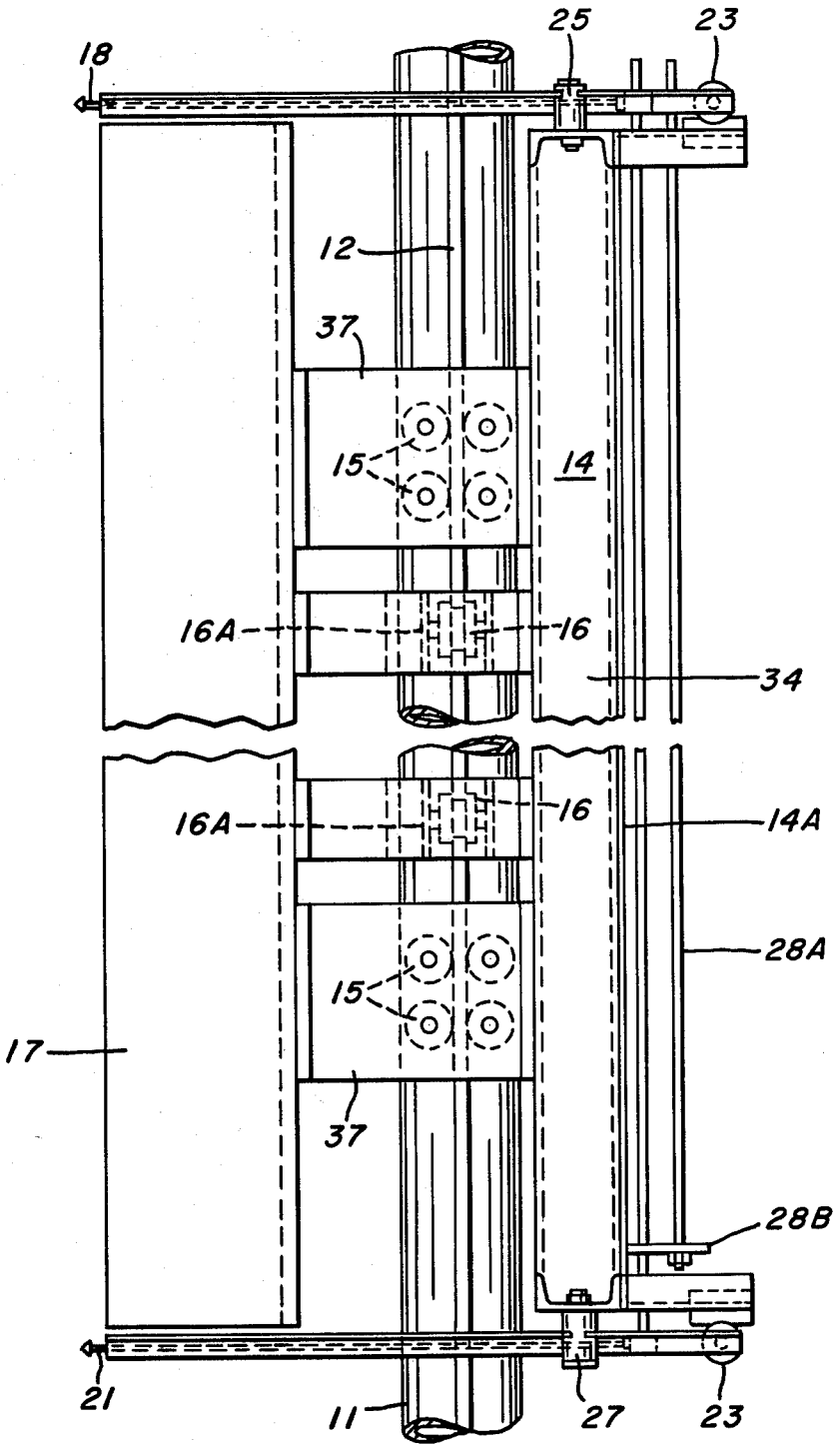
FIG. 2 is a side view, on an enlarged scale, of the carriage and cleaning nozzles shown in FIG. 1.
Figure 4:
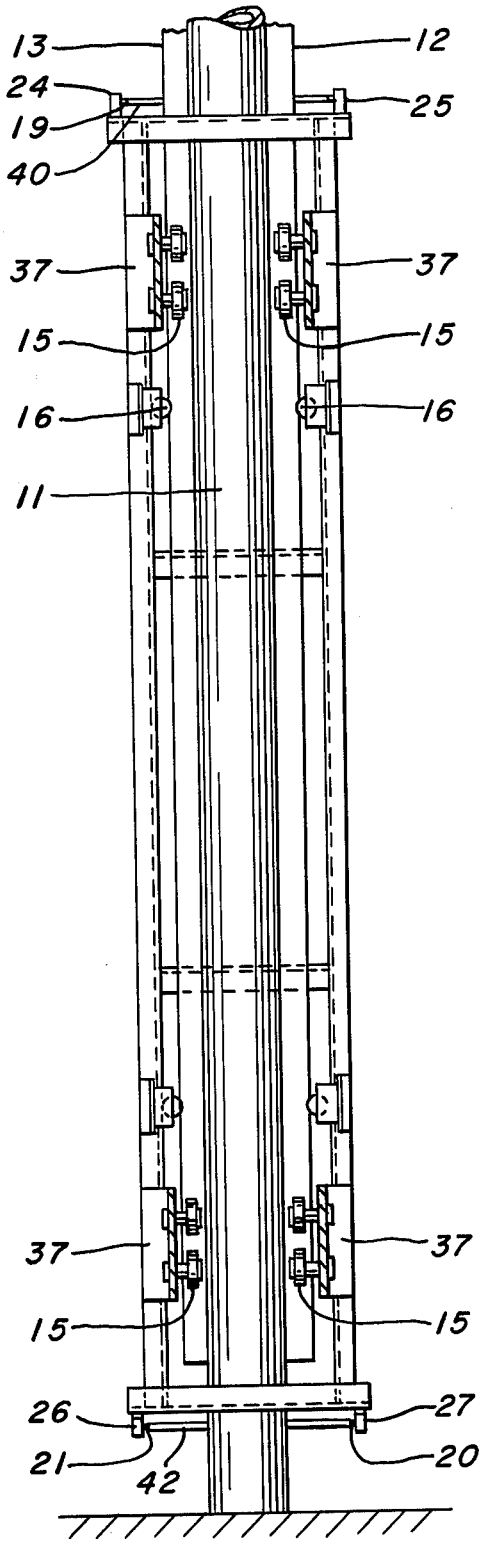
FIG. 4 is a vertical section taken substantially along line IV—IV of FIG. 1 showing details of the frame which carries the cleaning nozzles of the invention.

The frame can be raised or lowered by means of an elongated hydraulic cylinder 28 (FIG. 1) having its piston rod 28A connected to the lower end of the frame by means of a bracket 28B. In FIGS. 1 and 2, the frame is in its lowermost position. Carried by the structural members 34 of the frame 14 are four channel members 37 which carry rollers 15 (FIGS. 4 and 5). There are four rollers 15 on each channel member 37 arranged such that upper and lower sets of rollers engage opposite sides of the track rails 12 and 13. Additionally, rollers 16, rotatable about axes extending perpendicular to the axes of rotation of rollers 15, are carried on brackets 16A and engage the outer edges of the rails 12 and 13 (FIG. 6).

Mounted on top of the frame are two nozzle tubes 18 and 19 which are pivotal about points 24 and 25. Similarly, nozzle tubes 20 and 21 are pivotally mounted on the bottom of the frame at points 26 nd 27. When cleaning the vertically extending portions 10A between the sealing strip 31 and the plug 33, the nozzle tubes extend parallel to the side walls of the plug 33 as shown, for example, by nozzle tubes 18 and 19 in FIG. 5. The trailing ends of the tubes 18 and 19 are pivotally connected at 22 to hydraulic or pneumatic cylinders 23. Similarly, the lower nozzle tubes 20 and 21 are connected to the piston rods of hydraulic or pneumatic cylinders 23. With this arrangement, and as best shown in FIG. 5, the nozzle tube 18, for example, can pivot about point 24 from the full-line position where it is parallel to the side wall of plug 33 to the dotted-line position shown. In so pivoting, the forward end of the nozzle tube traverses approximately one-half of the horizontal space 10B between the sealing strip 31 at the top of the door 10 and the upper end of the sealing plug 33. The same is true of nozzle tube 19. That is, it can traverse the other half of the upper portion 10B just referred to when its cylinder 23 is actuated to pivot it inwardly about point 25. Such pivotal movement, of course, occurs only when the frame is at its uppermost position. Similarly, the lower nozzle tubes 20 and 21 can pivot inwardly about points 26 and 27 when the frame is in its lowermost position, shown in FIG. 1, to clean the horizontally-extending space 10B between the sealing strip 31 and the lower end of the plug 33. As best shown in FIGS. 5 and 6, a thermally-insulating shield 17 is carried on the forward ends of the channel members 37 and surrounds the hot plug 33 during a cleaning operation. The shield 17, however, does not extend into the path of travel of any of the nozzle tubes as they are pivoted inwardly.

Figure 3:
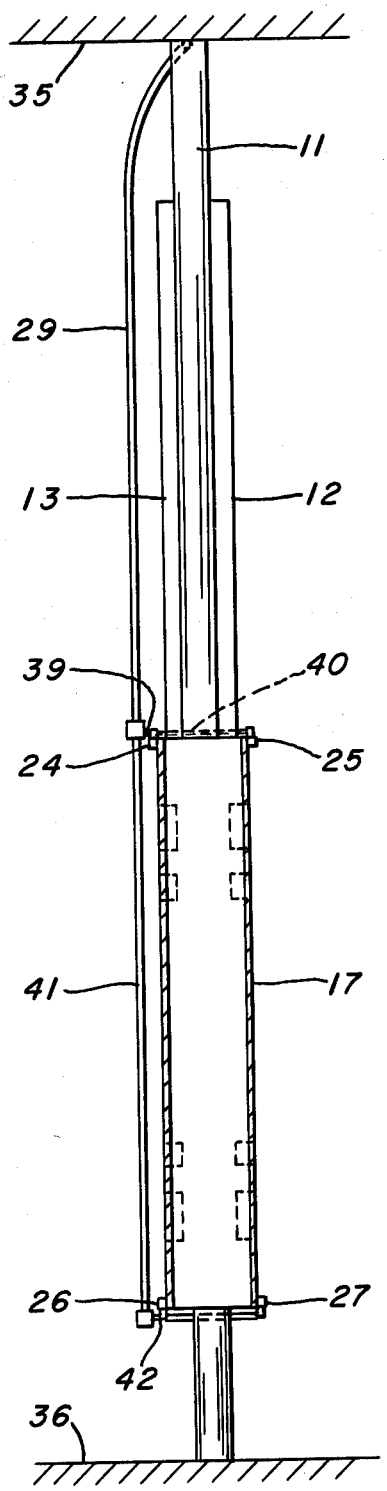
FIG. 3 is a vertical section taken substantially along line III—III of FIG. 1 showing the connection of the cleaning nozzles to a source of water under pressure.

Pressurized water is supplied to the nozzle tubes 18, 19, 20 and 21 from a flexible connecting duct 29. The duct 29 is connected through conduit 39 (FIG. 3) to nozzle tube 19 and from there via conduit 40 to nozzle tube 18 on the opposite side of the frame. The nozzle tube 18, in turn, is connected through conduit 41 (FIG. 3) to nozzle tube 21; and tube 21, in turn, is connected to tube 20 through conduit 42 corresponding to conduit 40 at the upper end of the frame. Valve members, not shown, are provided in the supply conduit for each individual nozzle tube such that the pressure of the jet from each nozzle tube can be separately controlled.

In the operation of the invention, all nozzle tubes are initially parallel to the sides of the refractory plug at the beginning of a cleaning operation with the cleaning at its lowermost position as shown in FIG. 1. The frame which carries the nozzle tubes is then slowly moved upwardly by the hydraulic cylinder 28 to the top limiting position. As the frame moves upwardly, pressurized water is sprayed from the lower nozzle tubes 20 and 21 into the region 10A between the door plug 33 and the sealing strip 31 to flush away any incrustations. When the frame reaches its uppermost position as viewed in FIG. 1, the upper two cylinders 22 are pressurized to relatively slowly move the forward ends of nozzle tubes 18 and 19 inwardly, thereby cleaning the region 10B between the upper end of the plug 33 and the upper, horizontally-extending portion of the sealing strip 31.

Thereafter, the flow of water to nozzle tubes 18 and 19 is terminated; and water is supplied to the lower nozzle tubes 20 and 21. As the frame is now lowered, the two lower nozzle tubes 20 and 21 will clean the vertically-extending areas or gaps 10A between the sealing plug 33 and the sealing strip 31. When the nozzle tubes 20 and 21 reach the bottom of the sealing strip 33, they are pivoted inwardly to clean the lower, horizontally-extending portion 10B between the bottom of the sealing plug and the sealing strip 31. Cylinders 23 at the bottom of the frame are then pressurized in the opposite sense; water flow to the nozzle tubes 20 and 21 is terminated; and cleaning of the door is completed.

If desired, a plurality of nozzles, each of which is individually controlled, can be arranged in a uniform distribution on the frame instead of only one pair of nozzles arranged on each side of the cleaning apparatus. In this latter case, the dimensions of the frame must be such that it is higher than one-half the door height. The path of travel through which the frame must be lifted, in this case, is reduced.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Apparatus for cleaning the regions of coke oven doors between a surrounding sealing edge and a refractory door plug, comprising a frame vertically reciprocable along the end of a coke oven door which carries said sealing plug, a first pair of nozzles carried on the upper portion of said frame and arranged to force fluid into the upper portions of those regions of the coke oven door between a surrounding sealing edge and the door plug, and a second pair of nozzles carried on the lower portion of said frame and arranged to force fluid into the lower portions of those regions of the coke oven door between said surrounding sealing edge and the door plug, said nozzles being pivotal about generally vertical axes such that the first pair of nozzles can be pivoted inwardly when they reach the upper edge of the coke oven door upon upward movement of the frame to clean the region between the upper edge of the door plug and the upper horizontally-extending portion of the sealing edge, the second pair of nozzles being pivotal inwardly when they reach the lower edge of the coke oven door upon downward movement of the frame to clean the region between the lower edge of the door plug and the lower horizontally-extending portion of the sealing edge.

2. The apparatus of claim 1 wherein said frame is provided with rollers which ride on track rails mounted on a vertical support column.

3. The apparatus of claim 1 including a thermally-insulated protective shield which surrounds the refractory door plug and is mounted on said frame.

4. The apparatus of claim 1 wherein said frame is caused to reciprocate by means of a hydraulic cylinder.

5. The apparatus of claim 1 including individual control valves for each of said nozzles.

* * * * *